US006817695B1

(12) United States Patent
Aldrich et al.

(10) Patent No.: US 6,817,695 B1
(45) Date of Patent: Nov. 16, 2004

(54) PRINTHEAD CAPPING ASSEMBLY

(75) Inventors: Charles Stanley Aldrich, Nicholasville, KY (US); Jeffrey Ray Ehlert, Lexington, KY (US); Martin Alan Johnson, Winchester, KY (US); Daniel Robert LaBar, Lexington, KY (US); Robert Michael Meadows, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 9 days.

(21) Appl. No.: 10/453,124

(22) Filed: Jun. 3, 2003

(51) Int. Cl.[7] ..... B41J 2/165
(52) U.S. Cl. ..... 347/29
(58) Field of Search ..... 347/22, 29, 30, 347/33

(56) References Cited

U.S. PATENT DOCUMENTS

| | | | | |
|---|---|---|---|---|
| 5,534,896 | A | 7/1996 | Osborne | |
| 5,563,637 | A | 10/1996 | Francis et al. | |
| 5,619,232 | A | 4/1997 | Maeno | |
| 5,661,510 | A | 8/1997 | Brandon et al. | |
| 5,751,324 | A | 5/1998 | Brandon et al. | |
| 5,867,184 | A | 2/1999 | Quintana | |
| 5,867,187 | A | 2/1999 | Toniolo | |
| 5,956,053 | A * | 9/1999 | Michael | 347/29 |
| 6,042,216 | A | 3/2000 | Garcia et al. | |
| 6,135,585 | A | 10/2000 | Johnson et al. | |
| 6,139,129 | A | 10/2000 | Tabasso et al. | |
| 6,220,689 | B1 | 4/2001 | Sturgeon | |
| 6,241,336 | B1 | 6/2001 | Muraki | |
| 6,273,562 | B1 | 8/2001 | Deshmukh | |
| 6,398,338 | B1 | 6/2002 | Berg et al. | |
| 6,398,339 | B1 | 6/2002 | Berg | |
| 6,402,293 | B1 | 6/2002 | Sawicki | |
| 6,533,388 | B2 | 3/2003 | Toh et al. | |
| 6,547,368 | B2 | 4/2003 | Silverbrook | |

OTHER PUBLICATIONS

PG Pub. 2004/0008236 (10/321,786), Yun, Suk–jin, Dec. 12, 2002, issued patent number pending.*

* cited by examiner

*Primary Examiner*—Shih-Wen Hsieh
(74) *Attorney, Agent, or Firm*—Taylor & Aust, P.C.

(57) ABSTRACT

A printhead capping assembly includes a cap holder, a printhead cap and a pin. The pin includes a head and a shaft. The shaft has a proximal end and a distal end, with the proximal end being adjacent to the head. The head has an outer periphery, and a bottom surface extending outwardly from the shaft toward the outer periphery. The pin has a channel including a first channel portion and a second channel portion. The first channel portion extends from the outer periphery of the head to the shaft. The first channel portion is connected to the second channel portion. The pin is inserted through the second hole and into the first hole to place the head in contact with the second base of the printhead cap. The second base of the printhead cap seals along the first channel portion to define a first vent path portion.

20 Claims, 3 Drawing Sheets

PRINTHEAD CAPPING ASSEMBLY

BACKGROUND OF THE INVENTION

1. Field of the Invention

The present invention relates to printhead maintenance in an imaging apparatus, and, more particularly, to a printhead capping assembly.

2. Description of the Related Art

Ink jet printers form an image on a print medium by selectively ejecting ink from one or more of a plurality of ink jet nozzles formed in a nozzle plate of an ink jet printhead. In order to maintain the printhead at an acceptable level of performance, ink jet printers typically include a maintenance station for performing scheduled maintenance operations and for providing a sealed environment for the printhead nozzle plate during periods of non-use.

One example of a maintenance station includes a movable maintenance sled including a printhead wiper and a printhead cap. The printhead wiper includes a blade edge for engaging the printhead nozzle plate to remove waste ink and contaminants that have accumulated on the printhead nozzle plate during printing. The printhead cap is moved by the maintenance sled from a non-contact position with respect to the printhead to a contact position with respect to the printhead in an attempt to provide a sealed environment around the ink jet nozzles of the printhead.

Typically, the cap is formed as a generally rectangular structure defined by four adjoining walls that extend vertically upwardly from a base, and is made from an elastomer, with an upper portion of the four adjoining walls defining a single sealing lip. Commonly, the elastomer cap is placed over the nozzle plate of the printhead in an attempt to provide a sufficiently humid environment to avoid undesirable drying and crystallization of ink on the printhead that may plug ink jet nozzles. Such a cap attempts to form an effective seal between the printhead nozzles and the ambient environment. However, where such an effective seal is formed, such a system may not provide adequate water containment evaporation.

What is needed in the art is a printhead capping assembly designed to maintain an effective seal around the printhead nozzle plate while providing adequate water containment evaporation at a desired evaporation loss rate.

SUMMARY OF THE INVENTION

The present invention provides a printhead capping assembly designed to maintain an effective seal around the printhead nozzle plate while providing adequate water containment evaporation at a desired evaporation loss rate.

The invention, in one form thereof, relates to a printhead capping assembly. The printhead capping assembly includes a cap holder, a printhead cap and a pin. The cap holder includes a first base, with the first base having a first hole. The printhead cap is positioned adjacent to the first base. The printhead cap includes a second base, with the second base having a second hole. The pin includes a head and a shaft. The shaft has a proximal end and a distal end, with the proximal end being adjacent to the head. The head has an outer periphery, and a bottom surface extending outwardly from the shaft toward the outer periphery. The pin has a channel including a first channel portion and a second channel portion. The first channel portion is formed in the head of the pin and extends from the outer periphery of the head to the shaft. The second channel portion is formed in the shaft. The first channel portion is connected to the second channel portion. The pin is inserted through the second hole and into the first hole to place the head in contact with the second base of the printhead cap. The second base of the printhead cap seals along the first channel portion of the head of the pin to define a first vent path portion.

Such a printhead capping assembly may be included in, for example, an ink jet printer.

In another form thereof, the invention relates to a printhead capping assembly, including a cap holder, a printhead cap and a pin. The cap holder includes a first base, with the first base having a first hole. The printhead cap is positioned adjacent to the first base. The printhead cap includes a second base, with the second base having a second hole. The pin includes a head and a shaft. The shaft has a proximal end and a distal end, with the proximal end being adjacent to the head. The head has an outer periphery, and a bottom surface extending outwardly from the shaft toward the outer periphery. The pin has a channel including a serpentine channel portion formed in the bottom surface of the head. The distal end of the shaft is inserted through the second hole and into the first hole to place the head in contact with the second base. The second base of the printhead cap seals along an extent of the serpentine channel portion to define a serpentine vent path portion.

In still another form thereof, the invention relates to a device. The device includes a pin including a head and a shaft. The shaft has a proximal end and a distal end, with the proximal end being adjacent to the head. The head has an outer periphery and a bottom surface extending outwardly from the shaft toward the outer periphery. A serpentine channel is formed in the bottom surface of the head.

An advantage of the invention is the ability to establish water containment evaporation with respect to a capped printhead at a desired evaporation loss rate by selection of an appropriate vent path length to width ratio.

Another advantage of the invention is the ability to establish an appropriate vent path length in a relatively small area.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, in one form, and such exemplifications are not to be construed as limiting the scope of the invention in any manner.

DETAILED DESCRIPTION OF THE INVENTION

Figure 1:
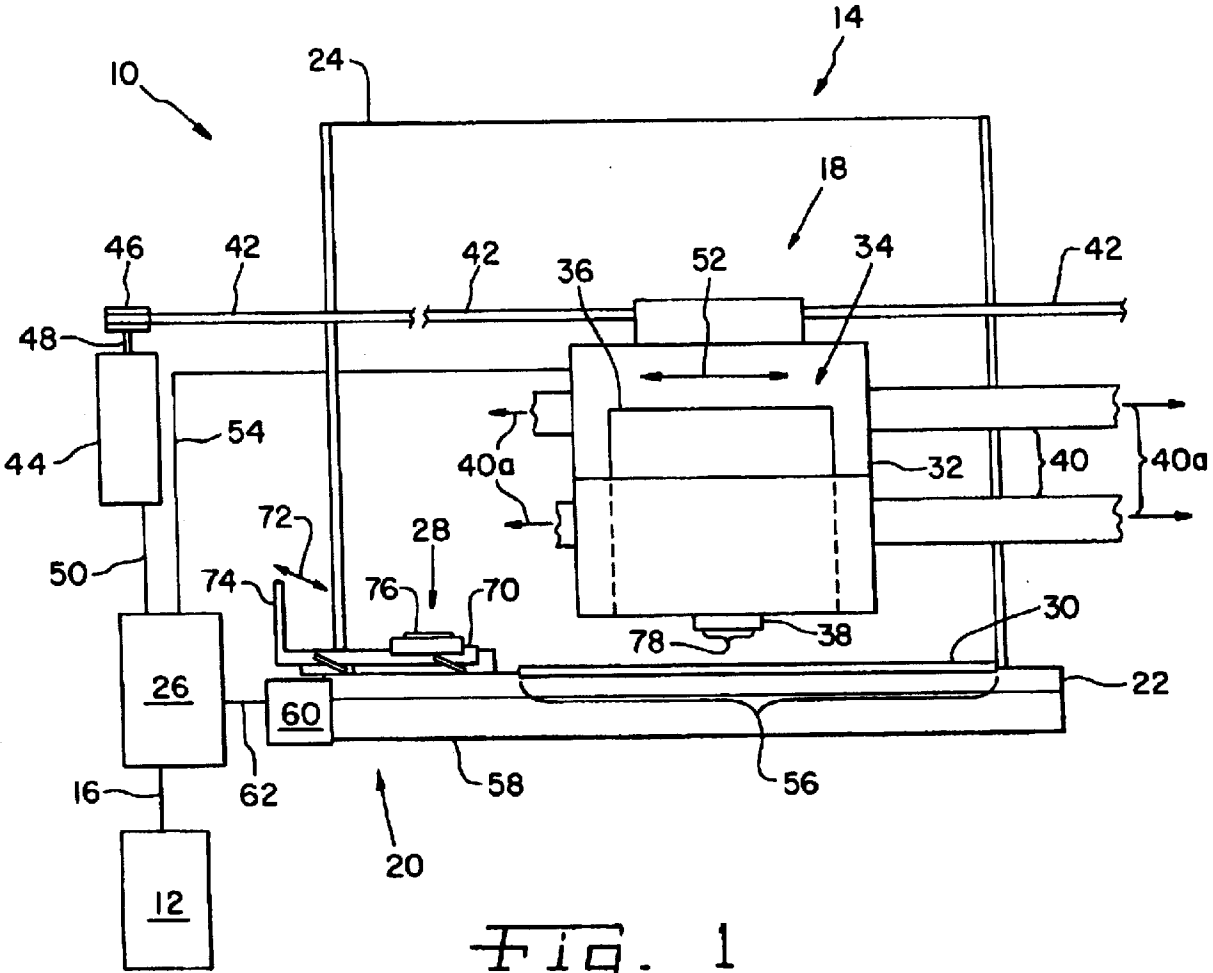
FIG. 1 is a diagrammatic representation of an imaging system employing an embodiment of the present invention.

Referring now to the drawings and more particularly to FIG. 1, there is shown an imaging system 10 employing an embodiment of the present invention. Imaging system 10 includes a computer 12 and an imaging apparatus in the form of an ink jet printer 14. Computer 12 is communicatively coupled to ink jet printer 14 by way of communications link 16. Communications link 16 may be, for example, a wired connection, an optical connection, such as an optical or r.f. connection, or a network connection, such as an Ethernet Local Area Network.

Computer 12 is typical of that known in the art, and includes a monitor to display graphics or text, an input device such as a keyboard and/or mouse, a microprocessor and associated memory, such as random access memory (RAM), read only memory (ROM) and a mass storage device, such as CD-ROM or DVD hardware. Resident in the memory of computer 12 is printer driver software. The printer driver software places print data and print commands in a format that can be recognized by ink jet printer 14.

Ink jet printer 14 includes a printhead carrier system 18, a feed roller unit 20, a mid-frame 22, a media source 24, a controller 26 and a maintenance station 28.

Media source 24 is configured and arranged to supply from a stack of print media a sheet of print media 30 to feed roller unit 20, which in turn further transports the sheet of print media 30 during a printing operation.

Printhead carrier system 18 includes a printhead carrier 32 for carrying one or more printhead cartridges, such as a color printhead cartridge and/or monochrome printhead cartridge, that is mounted thereto. For convenience and ease of understanding the invention, a single printhead cartridge 34 is shown. Printhead cartridge 34 includes an ink reservoir 36 provided in fluid communication with an ink jet printhead 38.

Printhead carrier 32 is guided by a pair of guide rods 40. The axes 40a of guide rods 40 define a bidirectional scanning path 52 of printhead carrier 32. Printhead carrier 32 is connected to a carrier transport belt 42 that is driven by a carrier motor 44 via a carrier pulley 46. Carrier motor 44 can be, for example, a direct current motor or a stepper motor. Carrier motor 44 has a rotating motor shaft 48 that is attached to carrier pulley 46. Carrier motor 44 is electrically connected to controller 26 via a communications link 50. At a directive of controller 26, printhead carrier 32 is transported, via the rotation of carrier pulley 46 imparted by carrier motor 44, in a reciprocating manner, back and forth along guide rods 40.

Ink jet printhead 38 is electrically connected to controller 26 via a communications link 54. Controller 26 supplies electrical address and control signals to ink jet printer 14, and in particular, to the ink jetting actuators of ink jet printhead 38, to effect the selective ejection of ink from ink jet printhead 38.

During a printing operation, the reciprocation of printhead carrier 32 transports ink jet printhead 38 across the sheet of print media 30 along bi-directional scanning path 52, i.e. a scanning direction, to define a print zone 56 of ink jet printer 14. Bi-directional scanning path 52, also referred to as scanning direction 52, is parallel with axes 40a of guide rods 40, and is also commonly known as the horizontal direction. The sheet of print media 30 is transported through print zone 56 by the rotation of feed roller 58 of feed roller unit 20. A rotation of feed roller 58 is effected by drive unit 60. Drive unit 60 is electrically connected to controller 26 via a communications link 62.

During each scan of printhead carrier 32, the sheet of print media 30 is held stationary by feed roller unit 20. Feed roller unit 20 includes a feed roller 58 and a drive unit 60.

Maintenance station 28 is provided for performing printhead maintenance operations on the ink jet nozzles of ink jet printhead 38. Such operations include, for example, a printhead spit maintenance operation, a printhead wiping operation and a printhead maintenance capping operation. Other services, such as for example, printhead priming and suction, may also be performed if desired by the inclusion of a vacuum device (not shown) of the type well known in the art.

Maintenance station 28 includes a movable maintenance sled 70, of a type which is well known in the art, that is configured for movement in the directions generally depicted by double-headed arrow 72. The directions generally depicted by double-headed arrow 72 include both horizontal and vertical components. Maintenance sled 70 includes a carrier engagement member 74. Maintenance sled 70 is biased by a spring (not shown) in a direction toward printhead carrier 32. Mounted to maintenance sled 70 is a printhead capping assembly 76 of the present invention.

With the orientation of components as shown in FIG. 1, a leftward movement of printhead carrier 32 causes printhead carrier 32 to engage carrier engagement member 74, thereby causing maintenance sled 70 to move to the left and upward, as illustrated by arrow 72, thereby raising printhead capping assembly 76 toward a capping elevation with respect to ink jet printhead 38. When printhead capping assembly 76 reaches the capping elevation, printhead capping assembly 76 will have fully engaged ink jet printhead 38 of printhead cartridge 34, thereby providing a seal in a region 78 containing an ink jet nozzle plate and its associated ink jet nozzles.

While in the embodiment described herein printhead capping assembly 76 is used on a maintenance sled type of printhead maintenance system, those skilled in the art will recognize that printhead capping assembly 76, as described in more detail below, may be incorporated into other types of printhead maintenance systems, such as for example, a rack type or rotary type maintenance system.

Figure 2:
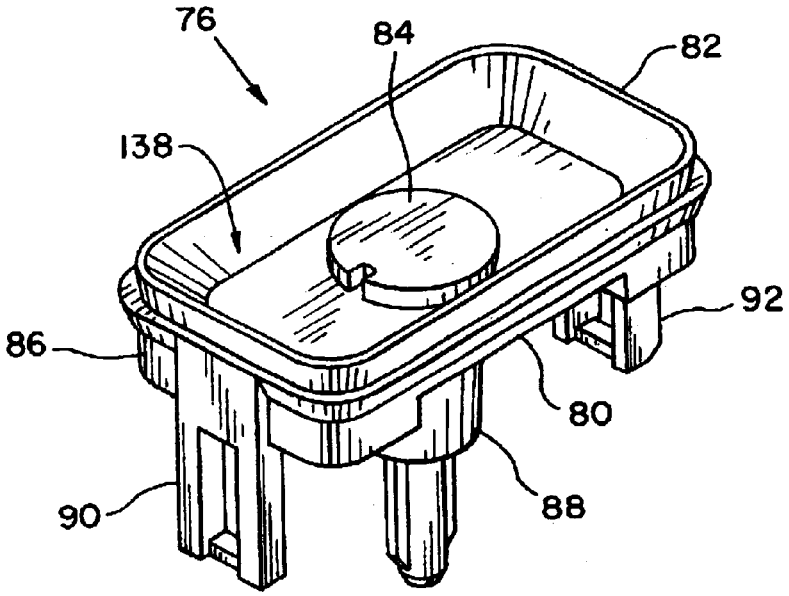
FIG. 2 is a perspective view of a printhead capping assembly included in the maintenance system of the ink jet printer of FIG. 1.
Figure 4:
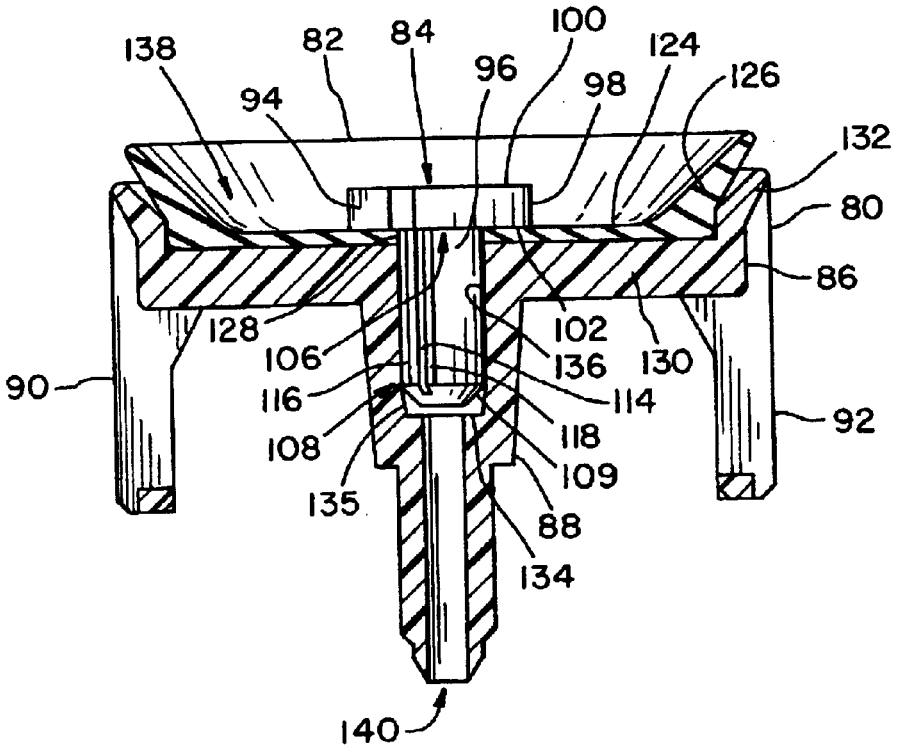
FIG. 4 is a sectioned side view of the printhead capping assembly of FIG. 2.

Referring to FIGS. 2 and 4, printhead capping assembly 76 includes a cap holder 80, a printhead cap 82 and a vent pin 84.

Cap holder 80 includes a body 86, a hollow extension member 88 and two mounting posts 90, 92. Mounting posts 90, 92 are used to attach printhead capping assembly 76 to a mounting fixture, such as maintenance sled 70, via a spring-loaded gimbaling mechanism (not shown). Body 86 is configured as an open housing to receive therein a portion of printhead cap 82. Vent pin 84 is configured to mount printhead cap 82 to body 86, and to facilitate a vent path that promotes a relatively low evaporation rate of fluids in printhead cap 82 when printhead cap 82 is raised into sealing engagement with printhead 38.

Figure 3A:
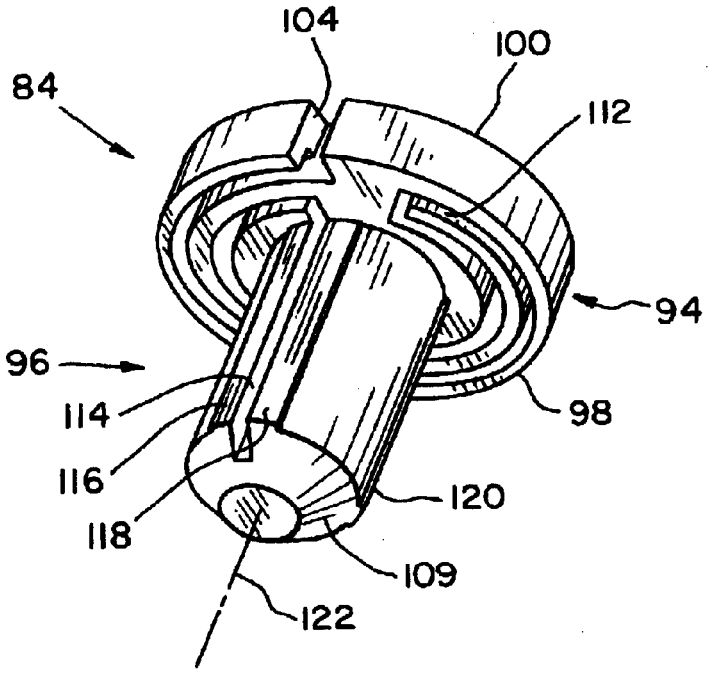
FIG. 3A is a perspective view of a cap pin included in the printhead capping assembly of FIG. 2.
Figure 3B:
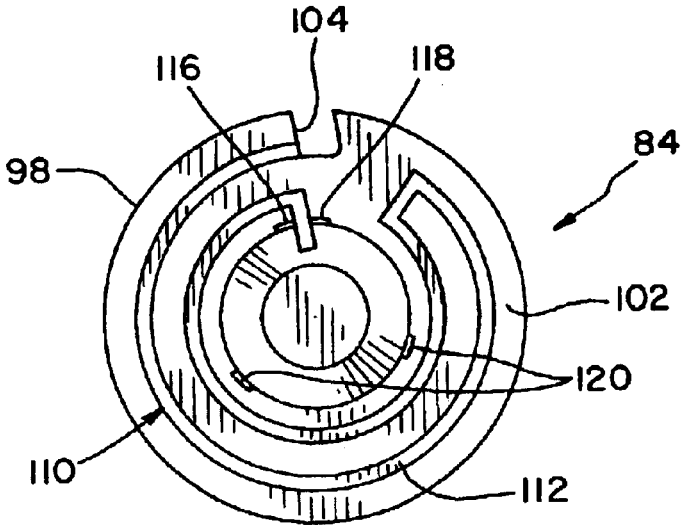
FIG. 3B is a bottom plan view of the cap pin of FIG. 3A.

Referring now to FIGS. 3A and 3B, vent pin 84 includes a head 94, and a shaft 96 extending from head 94. Head 94 having an outer periphery 98, a top surface 100, a bottom surface 102 and a notch 104. Bottom surface 102 extends outwardly from shaft 96 toward outer periphery 98 of head 94. Notch 104 extends radially inward from outer periphery 98 into head 94, and from top surface 100 to bottom surface 102. Shaft 96 has a proximal end 106 and a distal end 108. Proximal end 106 is adjacent to head 94. Distal end 108 includes a tapered portion 109.

Vent pin 84 has a channel 110 that extends from outer periphery 98 of head 94 at notch 104 to distal end 108 of shaft 96. Channel 10 includes a serpentine channel portion 112 formed in bottom surface 102 of head 94, and an elongate channel portion 114 formed in shaft 96. Positioned on each side of elongate channel portion 114 is a sealing rib 116 and a sealing rib 118, respectively, that extends along shaft 96 from head 94 toward distal end 108. At least one wedge rib 120 extends along shaft 96 from head 94 toward distal end 108, and is angularly displaced from sealing ribs 116, 118 with respect to an axis 122 of shaft 96. For example, if with respect to axis 122 sealing ribs 116, 118 are positioned at about a 0 degree reference position, then a pair of wedge ribs 120 may be positioned at 120 degrees and 240 degrees, respectively.

FIG. 4 is a sectioned side view of an assembled printhead capping assembly 76.

Printhead cap 82 includes a base 124 from which a sidewall portion 126 extends. Base 124 includes a hole 128 sized to snuggly receive shaft 96 of vent pin 84. Printhead cap 82 is made from an elastomer, such as rubber.

Body 86 of cap holder 80 includes a base 130 from which a sidewall portion 132 extends. Base 130 includes a hole 134 sized to snuggly receive shaft 96 of vent pin 84. In the embodiment shown, hole 134 extends through hollow extension member 88.

During assembly of printhead capping assembly 76, printhead cap is inserted into cap holder 80 until base 124 of printhead cap 82 is adjacent base 130 of cap holder 80. Sidewall portion 132 of cap holder 80 is sized to limit the flexure of sidewall portion 126 of printhead cap 82 when printhead cap 82 sealingly engages printhead 38. Hole 128 of printhead cap 82 and hole 134 of cap holder 80 are located to be substantially in axial alignment. Distal end 108 of shaft 96 of vent pin 84 is inserted through hole 128 of printhead cap 82 and into hole 134 of cap holder 80 such that bottom surface 102 of head 94 of vent pin 84 engages, e.g., contacts, base 124 of printhead cap 82. A vent pin stop 135 is formed in hole 134, e.g., built into hollow extension member 88, to engage shaft 96 of vent pin 84 so as to limit the extent of insertion of shaft 96 of vent pin 84 into hole 134 of cap holder 80.

Due to the elastomeric properties of printhead cap 82, base 124 of printhead cap 82 forms a seal against bottom surface 102 of head 94 of vent pin 84, so as to redefine serpentine channel potion 112 of channel 110 as a serpentine vent path portion that is in fluid communication with an open interior region 138 of printhead cap 82. For convenience, the serpentine vent path portion defined by serpentine channel portion 112 will be referred to using the same element number, i.e., serpentine vent path portion 112. Also, hole 128 of printhead cap 82 provides an interference fit for vent pin 84, but printhead cap 82 is the part that deforms because of the flexibility associated with printhead cap 82 being made of an elastomer, such as rubber.

Ribs 116, 118 and 120 of shaft 96 of vent pin 84 are sized to form an interference fit with respect to a sidewall 136 of hole 134, such that ribs 116, 118 and 120 are crushed or pressed upon their insertion into hole 134. Such an interference fit permits vent pin 84 to mount printhead cap 82 to cap holder 80. In addition, the interference fit between sealing ribs 116, 118 and sidewall 136 redefines elongate channel portion 114 of channel 110 as an elongate vent path portion, which is in fluid communication with hollow extension member 88 of cap holder 80, and in turn, in fluid communication with the atmosphere 140. For convenience, the elongate vent path portion defined by elongate channel portion 114 will be referred to using the same element number, i.e., elongate vent path portion 114.

For convenience, the vent path defined by channel 110 will be referred to using the same element number, i.e., vent path 110. The length and cross sectional areas of the vent path 110, including serpentine channel portion 112 and elongate channel portion 114, are selected so as to provide the desired evaporation rate of fluids in interior region 138 to atmosphere 140 when printhead cap 82 is in sealing relationship with printhead 38. In one exemplary embodiment, vent path 110 has a length to width ratio, e.g., length to diameter ratio, of for example 30:1 or larger. In one preferred embodiment, for example, the vent path may have a length to diameter ratio of about 50:1.

The design of printhead capping assembly 76 allows for vent pin 84 to be easily pressed into the cap holder 80 during assembly while insuring a complete seal, and lowering the risk of stressing parts that will lead to part failure. Vent pin stop 135 is configured and located so that vent pin 84 will not be inserted too far, and yet will stop the insertion of vent pin 84 without obstructing vent path 110.

In one embodiment, cap holder 80 and vent pin 84 are made from the same plastic material, so as to insure that the coefficient of thermal expansion will be the same for the two parts, and to insure that the seal for elongate vent path portion 114 will remain tight throughout environmental changes. Also, the interference fit between bottom surface 102 of head 94 of vent pin 84 and base 124 of printhead cap 82 allows for serpentine vent path portion 112 of vent path 110 to be sealed, and the amount of interference allows for the flatness tolerances in the elastomer of base 124 of printhead cap 82 to be increased.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A printhead capping assembly, comprising:

a cap holder including a first base, said first base having a first hole;

a printhead cap positioned adjacent to said first base, said printhead cap including a second base, said second base having a second hole; and a pin including a head and a shaft, said shaft having a proximal end and a distal end, said proximal end being adjacent to said head, said head having an outer periphery, and a bottom surface extending outwardly from said shaft toward said outer periphery, said pin having a channel including a first channel portion and a second channel portion, said first channel portion being formed in said head of said pin and extending from said outer periphery of said head to said shaft, said second channel portion being formed in said shaft, said first channel portion being connected to said second channel portion, said pin being inserted through said second hole and into said first hole to place said head in contact with said second base of said printhead cap, said second base of said printhead cap sealing along said first channel portion of said head of said pin to define a first vent path portion.

2. The printhead capping assembly of claim 1, further comprising a pair of sealing ribs positioned on opposite sides of said second channel portion, said pair of sealing ribs engaging a sidewall of said first hole in an interference fit to define a second vent path portion.

3. The printhead capping assembly of claim 2, wherein said printhead cap defines an open interior region, said channel defining a vent path from said open interior region of said printhead cap to the atmosphere.

4. The printhead capping assembly of claim 3, wherein said vent path has a length to width ratio of 30:1 or larger.

5. The printhead capping assembly of claim 3, wherein said vent path has a length to diameter ratio of about 50:1.

6. The printhead capping assembly of claim 1, wherein said first channel portion is configured as a serpentine channel portion formed in said bottom surface of said head.

7. The printhead capping assembly of claim 1, further comprising a stop formed in said first hole to engage said shaft of said pin to limit an extent of insertion of said shaft of said pin into said first hole.

8. A printhead capping assembly, comprising:

a cap holder including a first base, said first base having a first hole;

a printhead cap positioned adjacent to said first base, said printhead cap including a second base, said second base having a second hole; and a pin including a head and a shaft, said shaft having a proximal end and a distal end, said proximal end being adjacent to said head, said head having an outer periphery, and a bottom surface extending outwardly from said shaft toward said outer periphery, said pin having a channel including a serpentine channel portion formed in said bottom surface of said head, said distal end of said shaft being inserted through said second hole and into said first hole to place said head in contact with said second base, wherein said second base of said printhead cap seals along an extent of said serpentine channel portion to define a serpentine vent path portion.

9. The printhead capping assembly of claim 8, further comprising an elongate channel formed in said shaft, said serpentine channel portion being connected to said elongate channel portion.

10. The printhead capping assembly of claim 9, further comprising a pair of sealing ribs positioned on opposite sides of said elongate channel portion, said pair of sealing ribs engaging a sidewall of said first hole in an interference fit to define an elongate vent path portion.

11. The printhead capping assembly of claim 10, wherein said printhead cap defines an open interior region, said channel defining a vent path from said open interior region of said printhead cap to the atmosphere.

12. The printhead capping assembly of claim 11, wherein said vent path has a length to width ratio of 30:1 or larger.

13. The printhead capping assembly of claim 11, wherein said vent path has a length to diameter ratio of about 50:1.

14. The printhead capping assembly of claim 8, further comprising a stop formed in said first hole to engage said shaft of said pin to limit an extent of insertion of said shaft of said pin into said first hole.

15. A device, comprising a pin including a head and a shaft, said shaft having a proximal end and a distal end, said proximal end being adjacent to said head, said head having an outer periphery and a bottom surface extending outwardly from said shaft toward said outer periphery, said pin having a serpentine channel portion formed in said bottom surface of said head.

16. The device of claim 15, further comprising an elongate channel formed in said shaft, said serpentine channel portion being connected to said elongate channel portion.

17. An ink jet printer, comprising:

a printhead; and a printhead capping assembly to facilitate a capping of said printhead, said printhead capping assembly including:

a cap holder including a first base, said first base having a first hole;

a printhead cap positioned adjacent to said first base, said printhead cap including a second base, said second base having a second hole; and a pin including a head and a shaft said shaft having a proximal end and a distal end, said proximal end being adjacent to said head, said head having an outer periphery, and a bottom surface extending outwardly from said shaft toward said outer periphery, said pin having a channel including a first channel portion and a second channel portion, said first channel portion being formed in said head of said pin and extending from said outer periphery of said head to said shaft, said second channel portion being formed in said shaft, said first channel portion being connected to said second channel portion, said pin being inserted through said second hole and into said first hole to place said head in contact with said second base of said printhead cap, said second base of said printhead cap sealing along said first channel portion of said head of said pin to define a first vent path portion.

18. The ink jet printer of claim 17, further comprising a pair of sealing ribs positioned on opposite sides of said second channel portion, said pair of sealing ribs engaging a sidewall of said first hole in an interference fit to define a second vent path portion.

19. The ink jet printer of claim 18, wherein said printhead cap defines an open interior region, said channel defining a vent path from said open interior region of said printhead cap to the atmosphere.

20. The ink jet printer of claim 17, wherein said first channel portion is configured as a serpentine channel portion formed in said bottom surface of said head.

* * * * *